US008511274B2

(12) United States Patent
Bochart

(10) Patent No.: US 8,511,274 B2
(45) Date of Patent: Aug. 20, 2013

(54) ENGINE SPEED SENSITIVE OIL PRESSURE REGULATOR

(75) Inventor: Michael R. Bochart, Washington, IL (US)

(73) Assignee: Caterpillar Inc., Peoria, IL (US)

( * ) Notice: Subject to any disclaimer, the term of this patent is extended or adjusted under 35 U.S.C. 154(b) by 1691 days.

(21) Appl. No.: 11/980,675

(22) Filed: Oct. 31, 2007

(65) Prior Publication Data

US 2009/0107451 A1 Apr. 30, 2009

(51) Int. Cl.
*F01M 1/02* (2006.01)

(52) U.S. Cl.
USPC ..... 123/196 R; 123/196 S

(58) Field of Classification Search
USPC ..... 123/196 R, 196 S
See application file for complete search history.

(56) References Cited

U.S. PATENT DOCUMENTS

| | | | | |
|---|---|---|---|---|
| 3,520,201 | A | 7/1970 | Parker | |
| 3,640,258 | A * | 2/1972 | Isobe et al. | 123/365 |
| 3,967,612 | A | 7/1976 | Yamada | |
| 4,389,991 | A | 6/1983 | Gibson | |
| 5,291,086 | A | 3/1994 | Shekalim | |
| 5,339,776 | A | 8/1994 | Regueiro | |
| 5,752,483 | A | 5/1998 | Greaney et al. | |
| 5,884,601 | A | 3/1999 | Robinson | |
| 6,488,479 | B1 | 12/2002 | Berger | |
| 6,523,519 | B2 | 2/2003 | Iwano et al. | |
| 6,626,141 | B2 | 9/2003 | Choi | |
| 6,647,938 | B2 | 11/2003 | Gaessler et al. | |
| 6,739,305 | B2 | 5/2004 | Takahara et al. | |
| 2005/0142006 | A1 | 6/2005 | Voigt | |

FOREIGN PATENT DOCUMENTS

| | | | |
|---|---|---|---|
| JP | 09-088533 | A | 3/1997 |
| WO | WO 03/058071 | A1 | 7/2003 |

* cited by examiner

*Primary Examiner* — Noah Kamen
(74) *Attorney, Agent, or Firm* — Finnegan, Henderson, Farabow, Garrett & Dunner LLP

(57) ABSTRACT

A pressure regulator for a power source may include a housing in fluid communication with a pressurized fluid line and a reservoir, and a pressure relief valve having an open position that creates a flow path between the pressurized fluid line and the reservoir, and a closed position. The pressure relief valve may open when an opening force exerted by pressurized fluid entering the housing overcomes a closing force acting on the pressure relief valve, allowing pressurized fluid to flow from the pressurized fluid line to the reservoir. The pressure regulator may also include a governor coupled to the pressure relief valve, wherein the governor is configured to regulate the pressure in the pressurized fluid line by selectively adjusting the closing force exerted on the pressure relief valve based on engine speed.

19 Claims, 2 Drawing Sheets

ENGINE SPEED SENSITIVE OIL PRESSURE REGULATOR

TECHNICAL FIELD

The present disclosure relates to a pressure regulator, and, more particularly, to an engine speed sensitive oil pressure regulator for an internal combustion engine.

BACKGROUND

Internal combustion engines such as, for example, gasoline engines, diesel engines, and gaseous fuel powered engines, contain internal moving parts that rely on a pressurized fluid for proper lubrication. The fluid is often a high-viscosity oil, which is introduced between moving parts to create a thin, protective layer of oil, allowing the parts to be separated, thereby reducing friction and wear. A pump draws the fluid from a reservoir and pressurizes it, causing it to flow through passageways in the engine to moving parts that require lubrication. The pressure of the fluid is regulated by a pressure relief valve consisting of a spring-loaded spool, which relieves the fluid pressure by moving the spool against the spring to create a relief passage for the fluid when the pressure reaches a predetermined level.

For a rotating part of an engine that transports oil from its surface to its central axis of rotation, such as, for example, a crank journal that receives oil from an engine block and transports the oil to one or more rod journals, the oil pressure required for proper lubrication increases as the speed of the engine increases. That is, as the rotating speed of moving parts in the engine increases, the pressure required to effectively lubricate moving parts by creating a thin layer of oil between the parts increases. The increase allows the oil to overcome its own inertia to make its way to the center of a crankshaft of the engine. It may be beneficial to operate an engine with the lowest effective oil pressure, to reduce inefficiencies due to pumping losses, and life-reducing heat-cycling of the oil that occurs when dumping high pressure oil to the reservoir through the relief valve. To achieve the lowest effective pressure, the maximum allowable pressure is set to correspond to the required pressure at the maximum operating speed of the engine. Setting the maximum pressure entails adjusting a pre-load force of the spring against the spool in the relief valve.

Due to the location of the pressure regulator on the engine, manually adjusting the maximum allowable oil pressure during operation may not be practical. Though the maximum allowable pressure is generally set to correspond to the pressure required at the maximum operating speed of the engine, modern engines often operate in overspeed conditions that may exceed the maximum engine speed. An overspeed condition of an engine is common on engines that are used in mechanical drive applications. An overspeed condition may result from an operation such as engine braking on a steep grade. Because the engine speed during an overspeed condition may be much higher than at the maximum engine operating speed, the maximum allowable pressure setting of the pressure regulator may not be high enough to provide sufficient lubrication at overspeed conditions, if the maximum pressure was set to correspond to the maximum pressure required at a lower operating speed.

One attempt to vary the oil pressure with the engine speed is described in U.S. Pat. No. 6,488,479 B1 (the '479 patent), issued to Berger on Dec. 3, 2002. The '479 patent discloses a system that includes a variable pressure oil pump. The system also includes a controller (ECU) and various sensors, including an oil pressure sensor, an oil temperature sensor, an engine load sensor, an engine speed sensor, a coolant temperature sensor, and an oil viscosity sensor. The oil pump includes an adjustable pressure regulator that uses a solenoid to move a plunger to selectively allow passage of oil through a bypass when the pressure of the oil is too high. The ECU moves the solenoid to regulate the oil pressure based on inputs from the various sensors, and the ECU may allow a higher maximum oil pressure as the engine speed increases.

Although the system disclosed in the '479 patent may allow a higher maximum oil pressure as engine speeds increase, it may be complex and costly. Specifically, the '479 system requires not only a mechanism to vary the oil pressure, it also requires an ECU and multiple sensors. The additional components increase the control difficulty and expense of the system. The additional components also preclude the retrofit of an oil pressure regulation system on engines that do not include an ECU.

The disclosed pressure regulator is directed to overcoming one or more of the problems set forth above.

SUMMARY OF THE DISCLOSURE

In one aspect, the presently disclosed embodiments may be directed to a pressure regulator for a power source. The pressure regulator may include a housing in fluid communication with a pressurized fluid line and a reservoir. The pressure regulator may also include a pressure relief valve in the housing having an open position that creates a flow path between the pressurized fluid line and the reservoir, and a closed position. The pressure relief valve may be configured to open when an opening force exerted on the pressure relief valve by pressurized fluid entering the housing overcomes a closing force acting on the pressure relief valve, allowing pressurized fluid to flow from the pressurized fluid line to the reservoir to reduce pressure in the pressurized fluid line. The pressure regulator may further include a governor coupled to the pressure relief valve. The governor may be configured to regulate the pressure in the pressurized fluid line by selectively adjusting the closing force exerted on the pressure relief valve based on engine speed.

In another aspect, the presently disclosed embodiments may be directed to a method of regulating pressure in a pressurized fluid line of an engine assembly. The method may include coupling a pressure relief valve to the pressurized fluid line. The pressure relief valve may have an open position for reducing pressure in the pressurized fuel line, and a closed position. The method may also include exerting a closing force on the pressure relief valve using a biasing mechanism. The method may further include exerting an opening force on the pressure relief valve using the pressure in the pressurized fluid line. The pressure relief valve may open when the opening force exceeds the closing force. The method may further include regulating the pressure in the pressurized fluid line by selectively adjusting with a governor the amount of opening force required to open the pressure relief valve based on engine speed.

In yet another aspect, the presently disclosed embodiments may be directed to a power system including an engine assembly. The power system may also include a pressure regulator for the engine assembly. The pressure regulator may include a housing having a first opening fluidly coupled to a pressurized fluid line, a second opening fluidly coupled to the pressurized fluid line, and a third opening fluidly coupled to a reservoir. The pressure regulator may also include a pressure relief valve in the housing having an open position that creates a flow path between the first opening and the third opening, and a closed position. The pressure relief valve may be configured to open when an opening force exerted on the pressure relief valve by pressurized fluid entering the second opening overcomes a closing force acting on the pressure relief valve, allowing pressurized fluid to flow from the pressurized fluid line to the reservoir to reduce pressure in the pressurized fluid line. The pressure regulator may also include a governor coupled to the pressure relief valve. The governor may be configured to regulate the pressure in the pressurized fluid line by selectively adjusting the closing force exerted on the pressure relief valve based on engine speed.

DETAILED DESCRIPTION

Figure 1:
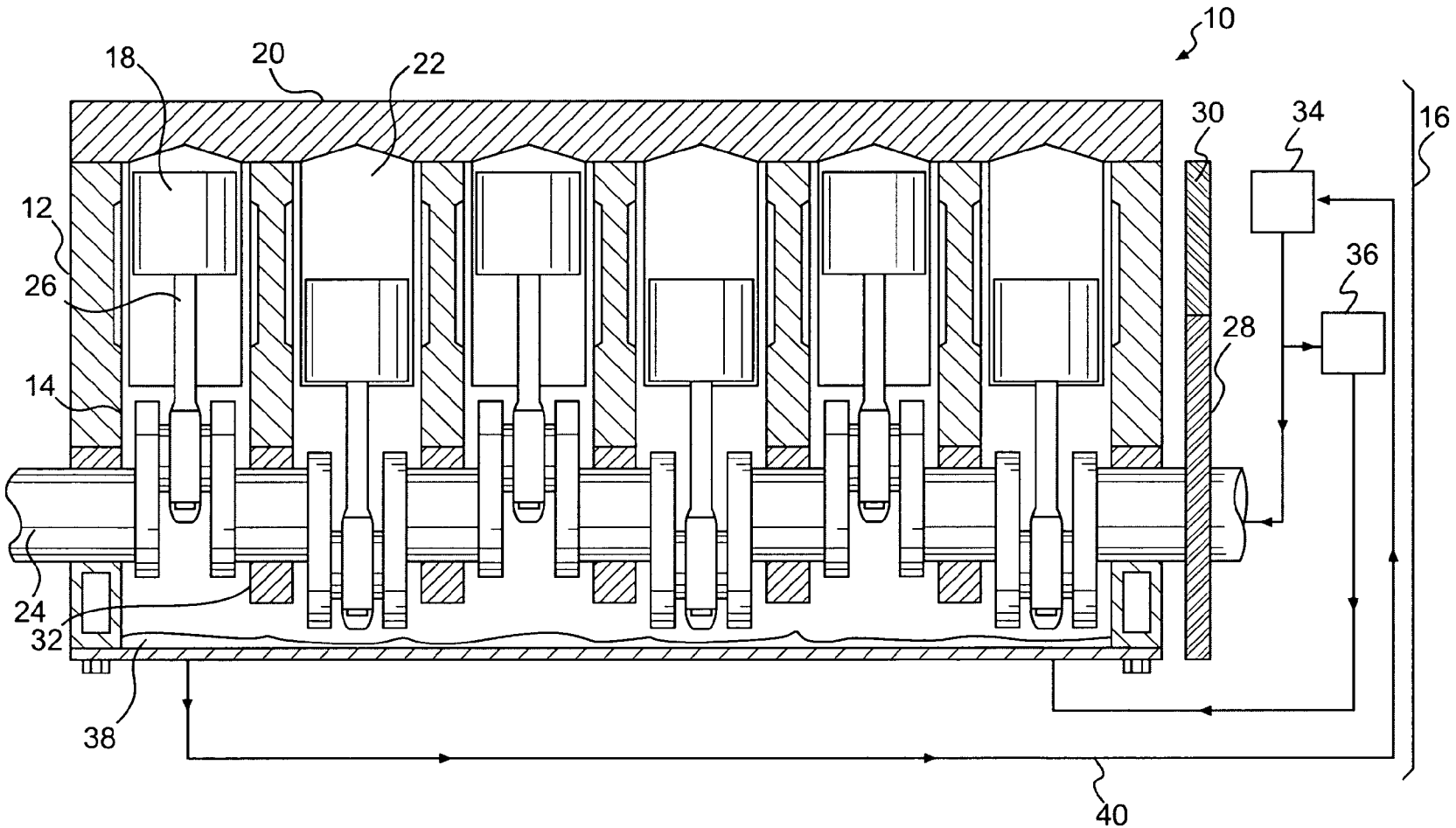
FIG. 1 is a schematic illustration of an exemplary disclosed power system.

FIG. 1 illustrates an exemplary embodiment of a power source 10. For the purposes of this disclosure, power source 10 is depicted and described as a four-stroke engine. One skilled in the art will recognize that power source 10 may embody any type of internal combustion engine such as, for example, a heavy fuel engine, a diesel engine, a gasoline engine, a gaseous fuel-powered engine, or any other suitable engine. Power source 10 may be configured to cooperate with a drive train (not shown) to provide motive power to a machine or vehicle (not shown). Power source 10 may further be configured to cooperate with the drive train to provide compression braking to slow the machine or vehicle. Power source 10 may have maximum operating speed, or redline speed, which is the maximum sustained speed at which power source 10 may safely and reliably operate to provide power or compression braking. Power source 10 may also be capable of operating in a overspeed condition for short periods of time. An overspeed condition may be a speed in excess of the maximum speed, and it may provide for extra motive power or extra compression braking as needed. Power source 10 may include an engine block 12 that defines a plurality of cylinders 14, and a lubrication system 16 that provides a pressurized lubricating fluid to engine block 12.

A piston 18 and a cylinder head 20 may be associated with each cylinder 14 to form a combustion chamber 22. Specifically, piston 18 may be slidably disposed within each cylinder 14 to reciprocate between a top-dead-center position and a bottom-dead-center position. Cylinder head 20 may be positioned to cap off an end of cylinder 14, the space within cylinder 14 between piston 18 and cylinder head 20 being the combustion chamber 22. In the illustrated embodiment, power source 10 includes six combustion chambers 22. However, it is contemplated that power source 10 may include a greater or lesser number of combustion chambers 22 and that combustion chambers 22 may be disposed in an "in-line" configuration, a "V" configuration, or in any other suitable configuration.

Power source 10 may also include a crankshaft 24 rotatably disposed within engine block 12. A connecting rod 26 may connect each piston 18 to crankshaft 24 so that a sliding motion of piston 18 between the top-dead-center and bottom-dead-center positions within each respective cylinder 14 results in a rotation of crankshaft 24. Similarly, a rotation of crankshaft 24 may result in a sliding motion of piston 18 between the top-dead-center and bottom-dead-center positions. Main gear 28 may be attached to crankshaft 24 on the outside of the engine block 12. Main gear 28 may be used to drive auxiliary gear 30 or any other gear of a gear train (not shown), which in turn may drive a variety of auxiliary systems and components (not shown). Power source 10 may contain other rotating and reciprocating components known in the art that require and receive lubrication from a source of pressurized fluid.

Crankshaft 24 may be supported by and rotate within one or more journal bearings 32. The journal bearings 32 may rely on hydrodynamic effects to create a thin layer of lubricating fluid between crankshaft 24 and journal bearings 32. The thin layer separates crankshaft 24 and journal bearing 32, preventing the two from coming into contact, and allowing crankshaft 24 to rotate freely within journal bearings 32. In cases where lubricating fluid may be transported from the surface of crankshaft 24 to the central axis of rotation of crankshaft 24, as the rotational speed of crankshaft 24 increases, the pressure of the lubricating fluid may also increase so that the lubricating fluid may be capable of overcoming its own inertia and make its way to the center of crankshaft 24. In cases where the lubricating fluid may be transported from one or more lubricating fluid passages (not shown) within crankshaft 24 to a lubricating surface of crankshaft 24, increased lubricating fluid pressure may serve the purpose of helping the lubricating fluid overcome internal inertia force in the one or more lubricating fluid feed passages, thus allowing the lubricating fluid to make its way toward the lubricating surface of crankshaft 24.

Lubrication system 16 may contain a pump 34, a pressure regulator 36, a reservoir or sump 38, and passageway or pressurized fluid line 40. Lubrication system 16 may provide a source of pressurized fluid to power source 10 through passageway 40, to lubricate reciprocating and rotating components, and to prevent metal-on-metal contact resulting from the motion thereof. Passageway 40 may connect the various components of lubrication system 16, and provide pressurized fluid to internal passages (not shown) of crankshaft 24, for lubrication of crankshaft 24 and journal bearings 32. Lubrication system 16 may contain other components commonly known in the art, such as, for example, a filter (not shown) configured to remove particles from the lubricating fluid.

Pump 34 may be driven by main gear 28 or any other gear of the power source 10 gear train, to provide pressurized lubricating fluid to power source 10 through passageway 40. Pump 34 may be a gear pump, a piston type pump, an impeller type pump, or any other type of pump known in the art. Pump 34 may draw fluid from sump 38, pressurize the fluid, and discharge the pressurized fluid into passageway 40. Pump 34 may repeat this cycle, continuously pumping lubricating fluid through passageway 40 during the operation of power source 10.

Pressure regulator 36 may relieve the pressure of the fluid in passageway 40 when the pressure exceeds a predetermined value. Pressure regulator 36 may be a spring-loaded spool-type valve as described in further detail below. Pressure regulator 36 may be located in passageway 40 downstream of pump 34, and may limit the maximum pressure of lubricating fluid entering engine block 12.

Sump 38 may be any metallic or polymeric chamber known in the art for holding a lubrication fluid. For example, sump 38 may be located at a bottom portion of power source 10, and function as a reservoir for lubrication system 16. Lubrication system may both begin and end at sump 38. Lubrication fluid may be drawn from sump 38 at a beginning of lubrication system 16, and trickle down through engine block 12 under gravity to be collected in sump 38 at an end of lubrication system 16.

Figure 2:
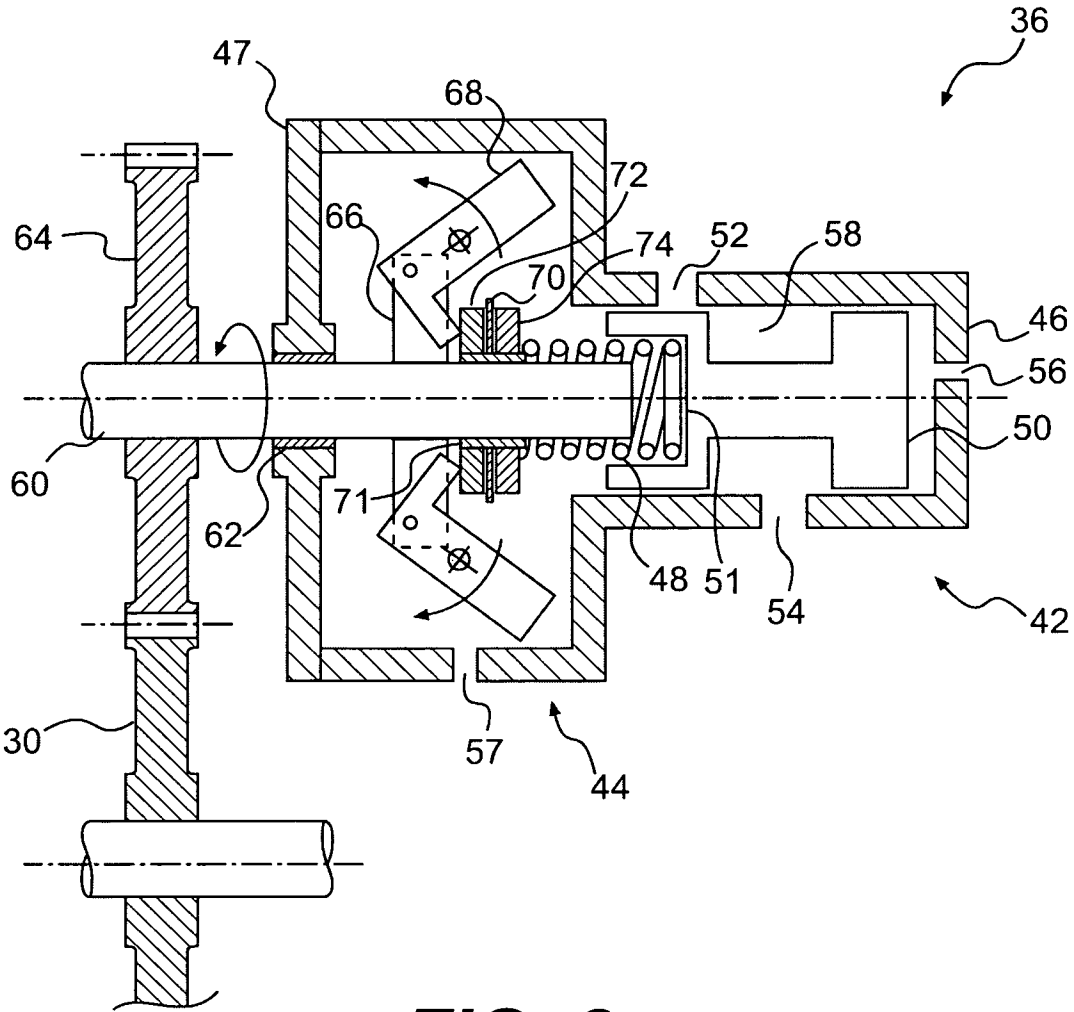
FIG. 2 is an illustration of a pressure regulator for use with the exemplary disclosed power system of FIG. 1.

FIG. 2 illustrates an exemplary embodiment of pressure regulator 36 for use with power source 10. Pressure regulator 36 may include a pressure relief valve 42 and a governor 44. Valve 42 may be arranged to receive pressurized fluid from pump 34 at inlet 52, and to direct fluid to sump 38 through outlet 54 when the pressure of the fluid exceeds a predetermined level. Governor 44 may be configured to adjust the predetermined pressure at which valve 42 will direct fluid to sump 38, based on a rotational speed of power source 10.

Valve 42 may include a housing 46, a biasing mechanism such as spring 48, and a spool 50. Housing 46 may include a cover 47, and housing 46 may enclose both valve 42 and governor 44. Housing 46 may be situated adjacent pump 34 and/or engine block 12, and may include inlet 52 connected to passageway 40, and outlet 54 connected to sump 38. Housing 46 may also include a pressure port 56 connected to passageway 40, and drain 57 connected to sump 38. Pressure port 56 may communicate to spool 50 a pressure of the fluid in passageway 40. Drain 57 may drain to sump 38 fluid that leaks past spool 50. Housing 46 may have a circular internal chamber within which spool 50 may be situated. Housing 46 may allow valve 42 to relieve the pressure of fluid pumped by pump 34. Valve 42 may also include additional elements, such as seals (not shown), to prevent fluid from leaking from housing 46, and/or into the area of housing 46 that contains governor 44. Alternatively, leakage past spool 50 may be controlled by tight tolerances between an inner diameter of housing 46, and an outer diameter of spool 50. Such tolerances may be on the order of, for example, one thousandth of an inch.

Spool 50 may be an elongated, cylindrical element located and configured for movement within housing 46, and may contain at one end a recess 51 for aligning spring 48, and a groove 58 to selectively allow fluid flow from inlet 52 to outlet 54. Groove 58 may be, for example, an annulus or any other suitably shaped groove known in the art. As the pressure of the fluid at pressure port 56 increases, the pressure will impart a force on an end face of spool 50, moving spool 50 toward spring 48. When spool 50 moves a predetermined distance toward spring 48, groove 58 may connect inlet 52 and outlet 54, thereby allowing fluid flow from inlet 52 to outlet 54, and on to sump 38. Fluid flow from inlet 52 to outlet 54 may result in a decrease in pressure of the fluid in passageway 40. When the pressure of the fluid at pressure port 56 decreases, the force on the end face of spool 50 may decrease, causing spring 48 to move spool 50 such that groove 58 not longer provides a flow path from inlet 52 to outlet 54. The outer diameter of spool 50 may be closely matched to an inner diameter of housing 46, leaving only a small clearance that prevents most fluid flow past spool 50 into the cavity housing governor 44, with minimal fluid leakage.

Spring 48 may be a compression spring, or any other similar type of elastic element known in the art that behaves as a linear spring. Spring 48 may be disposed axially with spool 50 in recess 51 to provide a varying resistance to the movement of spool 50 within housing 46. The varying resistance of spring 48 may result from a change in length of spring 48. Spring 48 may have a nearly linear spring rate, such that as spring 48 is compressed, the force required for additional compression of spring 48 increases linearly.

The linear forces on spool 50 may be balanced. That is, the force on spool 50 resultant from the pressure of fluid at pressure port 56, i.e. the pressure force, may be balanced by the force from spring 48, i.e. the spring force. As the pressure force increases, spool 50 may move toward spring 48, causing spring 48 to compress, thereby causing the spring force to increase to balance the pressure force. Though the forces on spool 50 may be balanced, the location of spool 50 within housing 46 may change depending upon the magnitude of the forces. The amount spool 50 moves may be controlled by the characteristics of spring 48, such as the initial length and the spring rate of spring 48. One may determine, based on the spring characteristics and the required spring force to balance the pressure force, the amount of compression of spring 48 that may occur when the forces are balanced. In this way, one may predict the movement of spool 50 within housing 46, and, consequently, the pressure force needed to move spool 50 the predetermined distance to cause groove 58 to create a passageway for flow from inlet 52 to outlet 54.

Governor 44 may be located in housing 46, adjacent valve 42, and may be configured to adjust the length of spring 48 by applying a force to spring 48. Governor 44 may include a shaft 60, a shaft bearing 62, a drive gear 64, a clevis 66, two or more flyweights 68, and a bearing assembly including a thrust bearing 70, a plain bearing 71, a first plate 72 located on the clevis side of thrust bearing 70, and a second plate 74 located on the spring side of thrust bearing 70.

Shaft 60 may be positioned within housing 46 by shaft bearing 62 pressed into cover 47. Shaft 60 may extend through spring 48, while stopping short of spool 50. The overall length of shaft 60 may be such that spool 50 may move within housing 46 to create a flow path from inlet 52, through groove 58, to outlet 54, without interference from shaft 60. Shaft 60 may be of sufficient length to allow plain bearing 71 sufficient movement to compress spring 48. Shaft 60 may alternatively or additionally be of sufficient length to act as a hard stop for spool 50, by preventing movement of spool 50 beyond a predetermined distance.

Shaft bearing 62 may be located in cover 47 and may support shaft 60. Shaft bearing 62 may be a plain or journal bearing commonly known in the art that allows shaft 60 to rotate. Drive gear 64 may be arranged on shaft 60, and disposed adjacent to auxiliary gear 30 such that auxiliary gear 30 and drive gear 64 drivingly mesh to cause a rotation of shaft 60 with a rotational speed proportional to the rotational speed of crankshaft 24. One having ordinary skill in the art will recognize that drive gear 64 may alternatively include any other means commonly known in the art for transferring rotational motion from crankshaft 24 to shaft 60.

Clevis 66 may be fixedly attached to shaft 60 to rotate with shaft 60, and may support two or more flyweights 68, arranged in radial symmetry around shaft 60. Clevis 66 may be located on shaft 60 such that it touches first plate 72 when in a static condition, that is, when shaft 60 is not rotating and flyweights 68 are not pivoted due to centrifugal force. In this manner, clevis 66 may act as a positive stop for spring 48 and spool 50.

Flyweights 68 may be pivotally attached to clevis 66. Flyweights 68 may be shaped and arranged such that as the rotational speed of shaft 60 increases, flyweights 68 pivot, and the distance between a center of gravity of each flyweight 68 and the axis of shaft 60 increases. This increasing distance may be due to an increased centrifugal force on flyweights 68 as the rotational speed of shaft 60 increases. As the distance increases, flyweights 68 may be configured to apply to first plate 72 a linear force proportional to the centrifugal force, thereby causing a linear movement of thrust bearing 70, and a compression of spring 48. Flyweights 68 may be arranged such that they do not apply a force to first plate 72 until a predetermined rotational speed of shaft 60 is attained. This predetermined rotational speed may be adjusted by controlling the distance between clevis 66 and thrust bearing 70. The predetermined rotational speed may also or alternatively be adjusted through selective design of the geometry and mass of flyweights 68, and/or a selection of spring characteristics of spring 48.

Plain bearing 71 may fit closely on the diameter of shaft 60, and allow for low-friction axial movement along shaft 60, and low-friction rotation against shaft 60. The length of plain bearing 71 may be long enough to prevent binding of plain bearing 71 on shaft 60 during axial movement. Thrust bearing 70 may be pressed tightly onto plain bearing 71 and be disposed between clevis 66 and spring 48. The fit between thrust bearing 70 and plain bearing 71 may be such that a first half of thrust bearing 70 facing plate 74 is held stationary and prevented from rotation relative to plain bearing 71. Thrust bearing 70 may be a commonly known thrust bearing. First plate 72 and second plate 74 may be located on either side of thrust bearing 70, and may provide a support surface against thrust bearing 70 for flyweights 68 and spring 48, respectively. First plate 72 may be pressed tightly against the rotating second half of thrust bearing 70 by flyweights 68 when in a pivoted configuration. Second plate 74 may be pressed tightly against the first non-rotating half of thrust bearing 70 by spring 48. First plate 72 and second plate 74 may be made from a metal or any other suitable material commonly known in the art. First plate 72 and second plate 74 may fit loosely on plain bearing 71.

Valve 42 and governor 44 may be configured such that an initial position of spool 50 positions groove 58 such that flow of fluid from inlet 52 to outlet 54 is prevented. For example, in an initial condition with no rotation of shaft 60 and no fluid pressure at pressure port 56, an end of spool 50 may rest on the housing in the area adjacent pressure port 56. First plate 72 may be touching clevis 66, and spring 48 may be in a compressed state. Valve 42 and governor 44 may further be configured such that when the pressure of the fluid at pressure port 56 reaches a predetermined level or threshold value, spool 50 may move the predetermined distance within housing 46 that positions groove 58 to allow fluid to flow from inlet 52 to outlet 54. This predetermined pressure level or threshold value may be the relief pressure of the lubricating fluid, i.e. the maximum allowable pressure of the lubricating fluid.

One having ordinary skill in the art will recognize that adjusting the characteristics of spring 48, such as the initial length and/or spring rate, may change the predetermined pressure required for spool 50 to move the predetermined distance. Valve 42 and governor 44 may additionally be configured such that flyweights 68 do not begin increasing the maximum allowable fluid pressure until shaft 60 is rotating at a predetermined speed that is indicative of power source 10 operating in an overspeed condition. That is, valve 42 and governor 44 may maintain a constant maximum pressure for all power source 10 operating speeds up to an overspeed condition, at which speed governor 44 may begin increasing a maximum allowable pressure proportionally with increasing power source 10 operating speed.

The operation of the exemplary embodiment shown in FIG. 2 will be described in detail below.

INDUSTRIAL APPLICABILITY

The disclosed pressure regulator may be applicable to any power source that includes a pressurized lubrication system. The disclosed pressure regulator may provide a system for altering the trigger pressure of a pressure regulator based on a speed of a component. For example, the pressure regulator may increase a maximum allowable oil pressure as a rotational speed of a power source increases. This may allow the maximum allowable oil pressure to be set lower during normal operating conditions, while allowing a higher maximum pressure during overspeed operating conditions. In this manner, inefficiencies due to pumping losses and unnecessary heating of the oil at lower power source operating speeds may be avoided, and proper lubrication of the power source may be obtained during overspeed operating conditions. The operation of the system shown in FIGS. 1 and 2 will now be explained.

Power source 10 may be operated to perform a variety of tasks, such as, for example, mechanically driving a vehicle. Operation of power source 10 may cause a rotation of crankshaft 24. Rotation of crankshaft 24 may cause a corresponding rotation of main gear 28, which in turn may cause a rotation of auxiliary gear 30.

Rotation of auxiliary gear 30 may cause rotation of drive gear 64, which may cause shaft 60 to rotate at a speed proportional to crankshaft 24. As the operating speed of power source 10 increases, the rotational speed of shaft 60 may increase. As shaft 60 rotates, clevis 66 also rotates, along with flyweights 68. Rotation of flyweights 68 may cause a distance between a center of gravity of flyweights 68 and the axis of shaft 60 to increase, due to an increasing centrifugal force acting on flyweights 68.

When shaft 60 rotates at operating speeds below an overspeed condition of power source 10, flyweights 68 may pivotally move and touch first plate 72, but they may not generate a centrifugal force sufficient to apply a linear force to first plate 72 that in turn compresses spring 48. That is, at speeds below an overspeed condition of power source 10, the force applied by flyweights 68 to first plate 72 may be below the force required to compress spring 48. Alternatively, flyweights 68 may be configured such that they do not touch first plate 72 until shaft 60 rotates at a speed corresponding to an overspeed condition of power source 10.

When shaft 60 rotates at a predetermined speed equal to an overspeed condition of power source 10, flyweights 68 may begin to apply a linear force, proportional to the centrifugal force, to first plate 72 and to thrust bearing 70 that is high enough to compress spring 48. As the operating speed of power source 10 increases beyond the threshold overspeed condition, shaft 60 may rotate faster, thereby increasing the force with which flyweights 68 push on first plate 72, and in turn increasing the compression of spring 48. As spring 48 is compressed in this manner, the maximum allowable pressure of the fluid in passageway 40 is proportionally increased.

Operation of power source 10 may also cause fluid to be drawn from sump 38 into pump 34, where the fluid is pressurized to flow through passageway 40, into power source 10 to lubricate various parts, and then returned to sump 38. The fluid may also flow into pressure port 56 of pressure regulator 36. The pressure of the fluid against spool 50 may generate a force to move spool 50 against spring 48. Because, during overspeed operation of power source 10, governor 44 may generate a force against spring 48 that increases as the rotational speed of power source 10 increases, the pressure of fluid required to move spool 50 may also increase as the rotational speed increases. In this way, the maximum allowable pressure of the fluid may increase as the rotational speed of power source 10 increases.

When the pressure of the fluid in passageway 40 reaches a maximum allowable pressure, the force of spring 48 on spool 50 and the force from the fluid on spool 50 may be balanced such that spool 50 moves a predetermined distance in housing 46, and allows the fluid to flow from inlet 52, through groove 58, to outlet 54, and on to sump 38. Spool 50 may remain in a position to allow flow from inlet 52 to outlet 54 for as long as the pressure of the fluid is high enough to generate a force on spool 50 to allow spool 50 to maintain a position that allows flow. When the pressure of the fluid falls below the maximum allowable pressure, spool 50 may move such that flow is no longer permitted from inlet 52 to outlet 54. When spool 50 is in a position to allow flow from inlet 52 to outlet 54, the pressure of the fluid may be prevented from increasing beyond the pressure at which spool 50 begins to allow flow across valve 42.

The pressure regulator disclosed in FIG. 2 may allow an increase in a maximum allowable pressure proportional to the rotational speed of a power source as the rotational speed of the power source increases. Such an increase in a maximum allowable pressure may allow the maximum allowable pressure to be set at a lower level for normal power source operations, while allowing a higher maximum allowable pressure during overspeed operation of the power source. The pressure regulator may also be retrofitted to power sources which lack sophisticated electronics, thereby providing a low cost, reliable means for increasing a maximum allowable oil pressure proportional to the operating speed of the power source.

It will be apparent to those skilled in the art that various modifications and variations can be made to the disclosed pressure regulator without departing from the scope of the disclosure. Other embodiments of the pressure regulator will be apparent to those skilled in the art from consideration of the specification and practice of the pressure regulator disclosed herein. It is intended that the specification and examples be considered as exemplary only, with a true scope of the disclosure being indicated by the following claims and their equivalents.

What is claimed is:

1. A pressure regulator for a lubrication system of an internal combustion engine, comprising:

a housing in fluid communication with a pressurized fluid line and a reservoir;

a pressure relief valve in the housing having an open position that creates a flow path between the pressurized fluid line and the reservoir, and a closed position;

wherein the pressure relief valve is configured to open when an opening force exerted on the pressure relief valve by pressurized fluid entering the housing overcomes a closing force acting on the pressure relief valve, allowing pressurized fluid to flow from the pressurized fluid line to the reservoir to reduce pressure in the pressurized fluid line; and a governor coupled to the pressure relief valve, wherein the governor is configured to regulate the pressure in the pressurized fluid line by selectively adjusting the closing force exerted on the pressure relief valve based on engine speed, wherein the governor includes a rotatable shaft extending into the housing, and a bearing assembly slidably mounted on the rotatable shaft, and wherein a distal surface of the bearing assembly contacts a biasing mechanism coupling the governor with the pressure relief valve.

2. The pressure regulator of claim 1, wherein the rotatable shaft is rotated by the engine.

3. The pressure regulator of claim 2, wherein the governor further includes a clevis coupled to the rotatable shaft.

4. The pressure regulator of claim 3, wherein the governor further includes at least two rotatable flyweights rotatably coupled to the clevis.

5. The pressure regulator of claim 4, wherein a first portion of each of the rotatable flyweights is configured to contact a proximal surface of the bearing assembly.

6. The pressure regulator of claim 5, wherein the rotatable flyweights are configured to rotate upon rotation of the rotatable shaft.

7. The pressure regulator of claim 6 wherein the rotatable flyweights are configured to push the bearing assembly towards the pressure relief valve as the rotatably flyweights rotate.

8. The pressure regulator of claim 1, wherein the pressurized fluid line is coupled to a pump, and wherein the pump is configured to pressurize the fluid in the pressurized fluid line.

9. The pressure regulator of claim 1, wherein the reservoir is a sump of an engine assembly.

10. A method of regulating pressure in a pressurized fluid line of a lubrication system of an internal combustion engine, comprising:

coupling a pressure relief valve to the pressurized fluid line, wherein the pressure relief valve has an open position for reducing pressure in the pressurized fuel line, and a closed position;

exerting a closing force on the pressure relief valve using a biasing mechanism;

exerting an opening force on the pressure relief valve using the pressure in the pressurized fluid line, wherein the pressure relief valve opens when the opening force exceeds the closing force; and regulating the pressure in the pressurized fluid line by selectively adjusting with a governor the amount of opening force required to open the pressure relief valve based on engine speed.

11. The method of claim 10, wherein regulating the pressure in the pressurized fluid line includes increasing the pressure in the pressurized fluid line in response to the engine speed rising above a threshold value.

12. The method of claim 11, wherein increasing the pressure in the pressurized fluid line is performed in response to engine speed reaching an overspeed condition.

13. The method of claim 11, wherein increasing the pressure in the pressurized fluid line includes increasing the opening force required to open the pressure relief valve so that pressure in the pressurized fluid line can increase until the pressure is high enough to produce the required opening force.

14. The method of claim 13, wherein increasing the opening force includes rotating a shaft of the governor with the engine assembly, causing one or more rotatable flyweights rotatably coupled to the shaft to exert the closing force on the pressure relief valve.

15. The method of claim 14, wherein the closing force exerted by the flyweights increases as rotational speed of the shaft increases.

16. The method of claim 10, wherein regulating the pressure in the pressurized fluid line includes decreasing the pressure in the pressurized fluid line in response to the engine speed falling below a threshold value.

17. The method of claim 16, wherein decreasing the pressure in the pressurized fluid line includes decreasing the opening force required to move the pressure relief valve to the open position to reduce pressure in the pressurized fluid line.

18. The method of claim 17, wherein pressure in the pressurized fluid line will maintain the pressure relief valve in the open position until the pressure is reduced to a point where the opening force exerted by the pressure cannot overcome the closing force.

19. A power system, comprising:

an engine assembly; and a pressure regulator for a lubrication system of the engine assembly, having:

a housing, including:

a first opening fluidly coupled to a pressurized fluid line, a second opening fluidly coupled to the pressurized fluid line, and a third opening fluidly coupled to a reservoir;

a pressure relief valve in the housing having an open position that creates a flow path between the first opening and the third opening, and a closed position;

wherein the pressure relief valve is configured to open when an opening force exerted on the pressure relief valve by pressurized fluid entering the second opening overcomes a closing force acting on the pressure relief valve, allowing pressurized fluid to flow from the pressurized fluid line to the reservoir to reduce a pressure in the pressurized fluid line; and a governor coupled to the pressure relief valve, wherein the governor is configured to regulate the pressure in the pressurized fluid line by selectively adjusting the closing force exerted on the pressure relief valve based on engine speed.

* * * * *